United States Patent [19]

Romig, Jr.

[11] 4,313,287

[45] Feb. 2, 1982

[54] INTERNALLY TENSIONED STRUCTURAL MEMBER AND METHOD OF ASSEMBLING SAME

[76] Inventor: Byron A. Romig, Jr., 3920 Eagle Rock Blvd., Los Angeles, Calif. 90065

[21] Appl. No.: 115,502

[22] Filed: Jan. 25, 1980

[51] Int. Cl.[3] ..... E04C 3/10

[52] U.S. Cl. ..... 52/223 R; 52/230; 52/730

[58] Field of Search ..... 52/223 R, 223 L, 730, 52/227, 230

[56] References Cited

U.S. PATENT DOCUMENTS

| | | | |
|---|---|---|---|
| 240,387 | 4/1881 | Cowdy | 411/187 |
| 833,263 | 10/1906 | Tracy . | |
| 1,552,300 | 9/1925 | Hersey . | |
| 2,016,273 | 10/1935 | Atwood . | |
| 2,303,394 | 12/1942 | Schorer . | |
| 2,347,879 | 5/1944 | Branton et al. . | |
| 2,615,678 | 10/1952 | Stent | 52/223 |
| 3,158,236 | 11/1964 | Caliguiri . | |
| 3,237,362 | 3/1966 | Fromson . | |
| 3,238,690 | 3/1966 | Wilkins . | |
| 3,300,927 | 1/1967 | Bettol . | |
| 3,327,441 | 6/1967 | Kelly . | |
| 3,405,490 | 10/1968 | Marr | 52/223 |
| 3,413,775 | 12/1968 | Katz | 52/727 |
| 3,698,150 | 10/1972 | Anderson | 52/731 |
| 3,708,380 | 1/1973 | Niebylski | 161/43 |
| 3,864,049 | 2/1975 | Ono | 52/227 |
| 3,882,650 | 5/1975 | Gugliotta | 52/223 |

*Primary Examiner*—Price C. Faw, Jr.
*Assistant Examiner*—Henry E. Raduazo
*Attorney, Agent, or Firm*—Fulwider, Patton, Rieber, Lee & Utecht

[57] ABSTRACT

A structural member having an enlongated body shell, which may be fiberglass, and a pair of end caps enclosing the ends of the shell. A plurality of bands extend through the shell connecting the caps and pulling them toward each other, thus rigidifying the member and securing the caps. Contact between the interior surfaces of the shell and the side edges of the bands causes the shell to resist collapse. At one end of the member, the bands are secured to the end cap by movable anchor piece. A tensioning member threadedly engages the anchor piece so that tension can be applied to the bands by rotating the tensioning member. At a predetermined tension, a drive piece connected to the tensioning member breaks away and serrations on the head of the tensioning member prevent it from counter-rotating to release the tension.

21 Claims, 5 Drawing Figures

INTERNALLY TENSIONED STRUCTURAL MEMBER AND METHOD OF ASSEMBLING SAME

FIELD OF THE INVENTION

The present invention relates to structural members, and, more particularly, to such members that include an outer shell of fiberglass or a similar material and to a method of assembling such members.

BACKGROUND OF THE INVENTION

Structural members such as tower legs and other columns are frequently made of steel or other metal and sometimes of wood. These conventional materials have become increasingly costly but, to date, little use has been made of alternative materials, such as fiberglass. Fiberglass has sufficient strength for many applications and has the advantage of being light in weight, which reduces shipping costs and makes the material easier to handle when a structure is being erected. In addition, it can be fabricated in a large variety of sizes and configurations, short production runs being feasible. Moreover, the amount of fiberglass incorporated in a member and the resulting load bearing capacity can be varied considerably without changing external dimensions.

One reason that fiberglass members have not come into common use is that it has proven very difficult to attach such members to the surrounding structure. It can be equally difficult to attach any components of the member that are not formed by the fiberglass itself.

A primary objective of the present invention is to provide an improved fiberglass structural member which overcomes the attachment difficulties previously associated with this material. A further objective is to provide such a member of increased strength and rigidity.

SUMMARY OF THE INVENTION

The present invention resides in a structural member that accomplishes the above objectives and in a method for the assembly of such a member. It includes an elongated body shell formed of fibers and a bonding medium, the shell having an open interior extending throughout. A pair of end caps are disposed across the ends of the shell and pulled toward each other by one or more bands in tension. The caps are thus secured to the shell. Preferably, the bands are filament wound loops.

It is advantageous to arrange interior surfaces of the shell so that they contact the side edges of the loops. Since the bands are rigidified by the tension, they resist collapse of the shell. Preferably, the shell is a multi-sided, box-like enclosure.

While the body shell can advantageously be formed of fiberglass, it is desirable to use metal for the end caps. Preferably, the end caps carry external fastening means.

In a preferred embodiment, the bands are attached to the end caps by anchor pieces, one of the anchor pieces being movable to apply tension to the bands. A preferred arrangement employs a movable anchor piece threadedly engaged by a tensioning member.

The tensioning member, which has a head received by a recess in the corresponding end cap, can be rotated by a drive member attached in such a manner that it breaks away once a predetermined tension has been applied. In one embodiments, serrations on the head of the tensioning member can engage the end cap to prevent counter-rotation that would result in a loss of tension.

Other features and advantages of the present invention will become apparent from the following detailed description, taken in conjunction with the accompanying drawings, which illustrate, by way of example, the principles of the invention.

DESCRIPTION OF THE PREFERRED EMBODIMENTS

Figures 1, 2, 3:
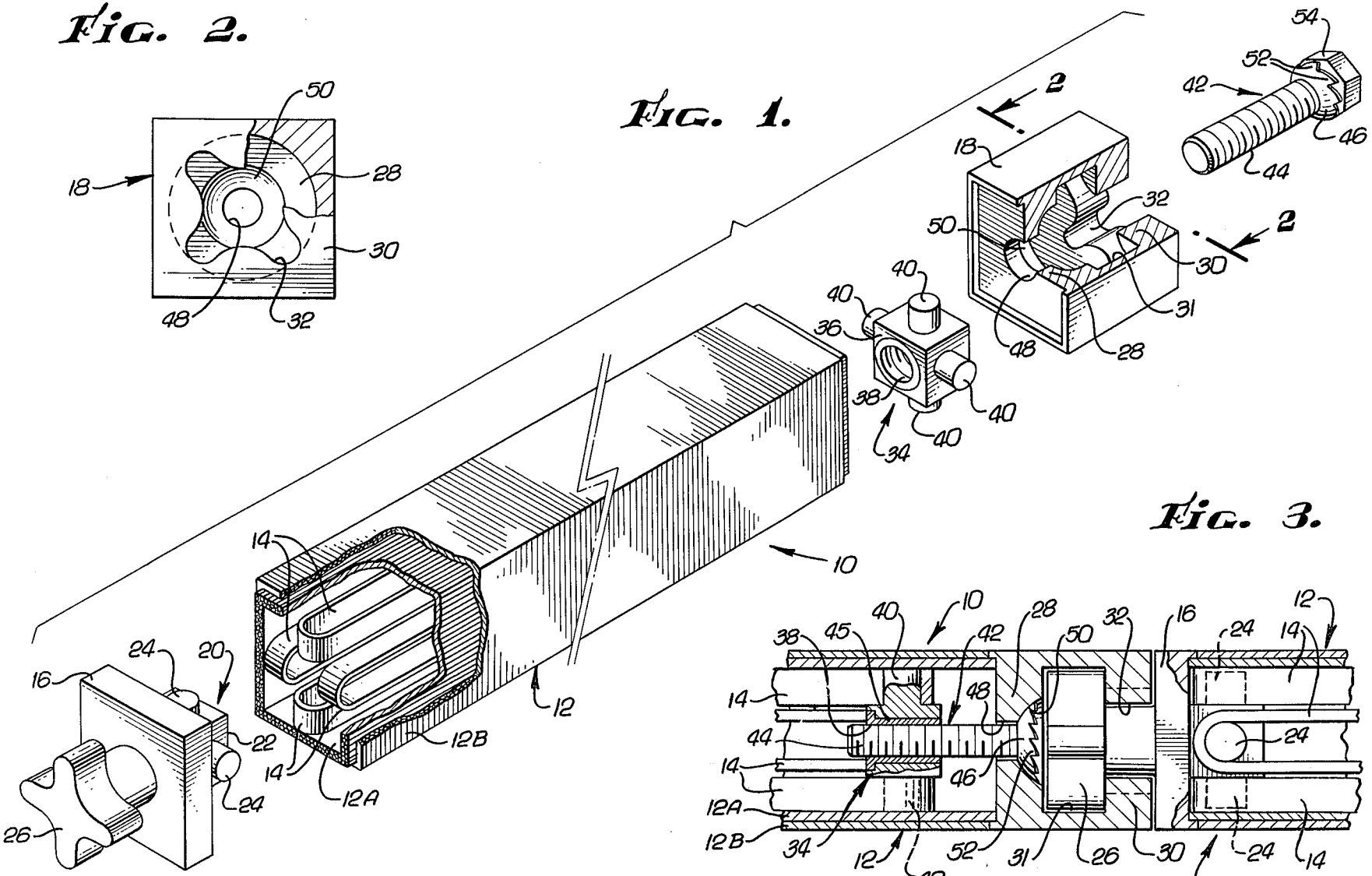
FIG. 1 is an exploded, three-dimensional view of a structural member constructed in accordance with the invention, part of the shell being broken away to expose the bands and part of one end cap being broken away to expose its interior.
FIG. 2 is an end view of an end cap taken as indicated by the line 2—2 in FIG. 1, a portion of the end cap being broken away to enclose its interior.
FIG. 3 is a fragmentary cross-sectional, side view of two attached structural members each similar to the member shown in FIG. 1.

A column 10, shown in FIG. 1 of the accompanying drawings, is suitable for use as, for example, a tower leg. It is exemplary of the many structural members that can be constructed in accordance with the present invention.

The beam 10 includes a four-sided, box-like, fiberglass body shell 12. The shell 12 is formed by an inner layer 12A that is filament wound parallel to the longitudinal axis of the column 10 and an outer layer 12B that is filament wound perpendicular to the longitudinal axis of the column. This technique for arranging the fibers within the resinous bonding material provides a shell 12 of superior strength. An alternative method of forming the shell 12 would utilize pulltrusion.

Within the shell 12 are four fiberglass bands 14 each of which is filament wound as a loop. Each of the bands 14 extends longitudinally throughout the open interior of the shell 12 and is oriented so that one of its two loop-shaped endless side edges is contiguous with the flat interior surface of a corresponding side of the shell 12. While this band construction is preferred, other types of band, such as woven steel cables, could be used.

Disposed across and covering the open ends of the shell 12 are steel end caps 16 and 18. The first end cap 16 is basically a steel plate that interlocks with one end of the shell 12. The inner layer 12A of the shell 12 projects slightly beyond the outer layer 12B and fits into the end cap to interlock and prevent transverse relative movement (note the right hand side of FIG. 3).

On the inside of the first end cap 16 is an internally formed anchor piece 20 that includes a rectangular support 22 projecting a short distance along the longitudinal axis of the shell 12 and four cylindrical lugs 24 that project radially from the support 22. Each of the lugs 24 is circled by an end of one of the bands 14, as shown in FIG. 3. On the outside of the first end cap 16 is a cross-shaped external fastener 26, the use of which will be explained below.

At the opposite end of the body shell 12, the second end cap 18 interlocks with the shell in the same manner as the first end cap 16. However, the second end cap 18 is of a different construction having two parallel plates 28 and 30 that define a cavity 31 between them. The inner plate 28 rests against the end of the shell 12.

The outer plate 30 is provided with a cross-shaped opening 32 that serves as an external fastener. This opening 32 is of the same configuration as the male fastener 26 at the opposite end of the column 10, but is rotationally displaced 45 degrees with respect to the male fastener. Accordingly, two similar columns 10 can be interlocked by inserting the male fastener 26 in the opening 32 and then rotating the flat sides of one column until they are aligned (see FIG. 3).

Just inside the second end cap 18 is a movable anchor piece 34 that includes a large four-sided nut 36 having a threaded opening 38 aligned with the longitudinal axis of the column 10. Four radially projecting cylindrical lugs 40 extend from the nut 36 to engage the ends of the bands 14. Thus, the bands 14 extend between the two anchors 20 and 34.

To retain and position the movable anchor 34 is a function of a tensioning member 42 that includes a threaded shank 44 and an enlarged convex head 46 at its outer end. The shank 44 extends through a central aperture 48 in the inner plate 28 and is received by the threaded opening 38 of the anchor 34. A concave, counter-sunk recess 50 in the outer surface of the inner plate 28 surrounds the aperture 48 and receives the head 46 of the tensioning member 42. Serrations 52 on the head 46 engage the surface of the recess 50 to prevent undesired rotation of the tensioning member 42.

To assemble the column 10, the bands 14 are placed within the body shell 12 so that they protrude from the open end where the second end cap 18 is to be positioned. The protruding ends can then be looped over the lugs 40 of the movable anchor piece 34. The free ends of the bands 14 are then withdrawn from the opposite end of the shell 12 so that the movable anchor piece 34 is pulled into the shell. It is then possible to connect the bands 14 to the lugs 24 of the fixed anchor piece 20. The bands 14 and movable anchor piece 34 are then moved back toward the second end cap 18 until the first end cap 16 interlocks with the body shell 12 as explained above.

The second end cap 18 is then interlocked with the opposite end of the body shell 12 to close the column 10. At this point, the bands 14 are only losely held. Next, the tensioning member 42 is inserted through the aperture 48 of the second end cap 18 so that the shank 42 engages the threads of the movable end anchor 34.

At this stage in the assembly of the column 10, the tensioning member 42 carries a break away drive piece 54 that, along with the head 46 to which it is attached, passes through the center of the cross-shaped opening 32 of the second end cap 18. The drive piece 54 (hexagonal in this example) is engaged by a suitable tool to rotate the tensioning member 42. Rotation in the proper direction causes the movable anchor 34 to be pulled toward the second end cap 18. In this manner, the bands 14 are stretched between the two anchors 20 and 34. After a predetermined tension has been applied to the bands 14, the drive piece 54 breaks off and can be extracted from the second end piece 18 through the cross-shaped opening 32. The serrations 52 do not interfere with rotation of the tensioning member 42 in the direction that increases the tension on the bands 14. They do, however, bite into the surface of the recess 50 to prevent tension reducing counter-rotation.

It will be noted that the metal end caps 16 and 18 are thus firmly and permanently secured to the body shell 12 by the tension of the bands 14. It is not necessary to use glue or other mechanical fasteners that would necessarily depend on the strength and integrity of a relatively small portion of the fiberglass shell 12 at the point of attachment. In addition, the bands 14 strengthen and rigidify the column 10 to inhibit any type of twisting or bowing since at least one of the bands 14, which are in tension, would resist the elongation that would necessarily accompany any such deflection. Another function of the bands 14 is to strengthen the sidewalls of the shell 12 which are in contact with the endless loop-shaped side edges of the bands tact, thereby preventing the shell from collapsing.

Figures 4, 5:
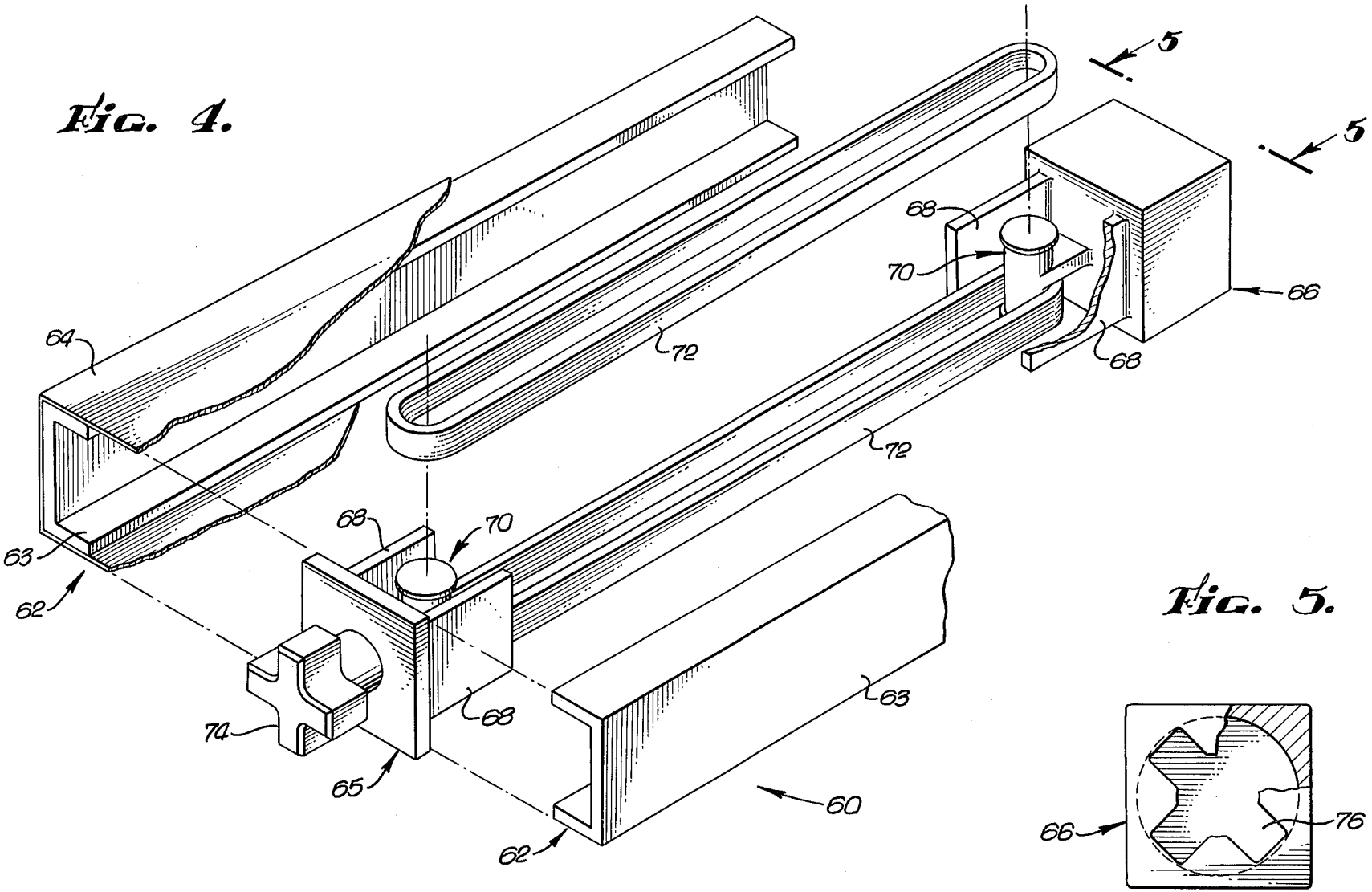
FIG. 4 is an exploded, three-dimensional view of another structural member constructed in accordance with the invention.
FIG. 5 is an end view of the structural member of FIG. 4 taken as indicated by the arrows 5.

Another column 60, as shown in FIGS. 4 & 5, is also constructed in accordance with the invention but omits the more complex tensioning arrangement of the column 10 described above. It has a multi-directionally wound fiberglass body shell 62 formed by two elongated channel-shaped members 63 that come together to form a four-sided, box-like structure wrapped by a decorative outer layer 64. It is closed at the ends by first and second end caps 65 and 66 that are similar to the end caps 16 and 18 of the beam 10. The two columns 10 and 60 differ, however, in that the end caps 65 and 66 of the second column 60 each carry two relatively large plate-like projections 68 that fit into the shell 62. Instead of having four cylindrical lugs like the lugs 24 of the column 10, the end caps 65 and 66 of the column 60 each carry an anchor piece 70 that forms only two such lugs. Each of these anchor pieces 70 is intergrally formed with one of the end caps 65, 66 and thus as a fixed position once a corresponding end cap is in place. There are only two filament wound fiberglass bands 72 that engage the lugs 70 and pull the end caps 65 and 66 toward each other so that the shell 62 is firmly held in compression between the two end caps. The inside of the shell 62 can be in contact with the side edges of the bands 72.

To assemble the column 60, the bands 72 are looped over the anchor 70 and the two end caps 65 and 66 are pulled apart, gripping them by two external fasteners 74 and 76 similar to the fasteners 26 and 32 of the column 10. The channel shaped members 63 are then positioned between the end caps 64 and 66 and the tension of the bands 72 is allowed to pull the end caps toward each other. The column 60 can, if desired, be disassembled by reversing these steps.

Like the first column 10, the second column 60 retains the advantages of light weight and high strength associated with fiberglass. In addition, the parameters of the columns 10 and 60 can be varied with relative ease during the manufacturing process by changing the thickness of the fiberglass or varying the materials used without changing external dimensions significantly. The rigidity of the columns 10 and 60 can be altered by changing the tension of the bands 14 and 72.

While a particular form of the invention has been illustrated and described, it will be apparent that various modifications can be made without departing from the spirit and scope of the invention.

I claim:

1. A structural member comprising:

an elongated body shell formed by fibers and a bonding medium, said body shell having an interior surface defining an opening extending throughout said body shell between two ends thereof;

a pair of end caps disposed across said ends; and at least one elongated band disposed within said body shell connecting said caps and pulling said end caps toward each other and against said body shell, said band contacting said interior surface substantially throughout the length thereof, thereby strengthening and rigidifying said body shell.

2. The structural member of claim 1 wherein said band forms a loop and each of said end caps includes anchor means for engaging said band.

3. The structural member of claim 1 further comprising exterior fastening means for fastening said end caps to other members.

4. The structural member of claim 1 further comprising:

anchor means for securing said band to one of said end caps; and tensioning means for adjustably positioning said anchor means, whereby tension is applied to said band.

5. The structural member of claim 5 wherein:

said anchor means has a threaded opening therein; and said tensioning means includes a threaded shank received by said threaded opening.

6. The structural member of claim 4 wherein said tensioning means further includes a plurality of serrations engaging one of said end caps, said serrations being oriented to prevent rotation of said tensioning means in a direction that would reduce the tension on said band.

7. The structural member of claim 1 wherein said band is formed by one or more filaments wound to form a loop.

8. The structural member of claim 1 wherein said band forms a loop having two parallel, endless side edges, said interior surface contacting said band along one of said side edges.

9. The structural member of claim 1 wherein said body shell is formed by a plurality of separable sections.

10. The structural member of claim 1 wherein said body shell is of a box-like configuration formed by two parallel channel shaped sections.

11. A structural member comprising:

an elongated, multi-sided, box-like fiberglass body shell having two open ends;

a pair of end caps engaging said ends;

four loop-shaped bands extending longitudinally through said body shell, each of said bands having two parallel, endless side edges, said body shell having interior surfaces in contact with said side edges of said bands; and anchor means for connecting said bands to said end caps.

12. The structural member of claim 11 further comprising exterior fastening means for fastening said end caps to other members.

13. The structural member of claim 11 further comprising tensioning means associated with one of said end caps for adjustably positioning said anchor means whereby tension is applied to said bands.

14. The structural member of claim 12 wherein said anchor means has a threaded opening therein and said tensioning means includes a threaded shank engaged by said threaded opening.

15. The structural member of claim 11 wherein said tensioning means further includes a plurality of serrations engaging said associated end cap to prevent undesired counter-rotation of said tensioning member.

16. A structural member comprising:

an elongated, body shell formed by fibers and a bonding medium, said body shell having an open interior extending throughout between two ends;

a pair of end caps engaging said ends;

at least one elongated band extending longitudinally through said body shell;

anchor means for connecting said band to said end caps, said anchor means including an anchor piece at one end of said body shell having a threaded opening therein; and tensioning means for adjustably positioning said anchor piece comprising a threaded shank received by said threaded opening, a head attached to said shank, and a plurality of serrations on said head, one of said end caps having a recess therein in which said head is received and wherein said serrations engage said end cap, said serrations being oriented to prevent rotation of said shank in a direction that would reduce the tension on said band.

17. The structural member of claim 16 wherein said tensioning means further comprises drive means connected to said head for rotating said tensioning means and for breaking away from said head when a predetermined tension has been applied.

18. A structural member comprising:

an elongated, four-sided box-like, fiberglass body shell having two opposite ends;

a pair of metal end caps engaging said ends;

four loop-shaped filament wound bands extending longitudinally through said body shell, each of said bands, having two parallel, endless side edges, said body shell having four flat interior surfaces each in contact with one of said side endges;

anchor means for connecting said bands to said caps, said anchor means including an anchor piece at one end of said body shell having a threaded opening therein; and tensioning means for adjustably positioning said anchor piece comprising a threaded shank engaged by said threaded opening, a head attached to said shank, a plurality of serrations on said head, and drive means attached to said head for rotating said tensioning means and for breaking away from said head when a predetermined tension has been applied;

one of said end caps having a recess therein in which said head is received and wherein said serrations engage said end cap.

19. A structural member comprising:

an elongated fiberglass body shell having two opposite ends;

a pair of metal end caps engaging said ends;

at least one band extending longitudinally through said body shell;

anchor means for connecting said band to said end caps, said anchor means including an anchor piece at each end of said body shell having a threaded opening therein; and tensioning means for adjustably positioning said anchor piece comprising a threaded shank engaged by said threaded opening and drive means for rotating said tensioning means and for breaking away when a predetermined tension has been applied.

20. The structural member of claim 19 wherein:

said tensioning means includes a head attached to said shank;

one of said end caps is engaged by said head to prevent movement of said shank toward said band; and said drive means is attached to said head.

21. The structural member of claim 20 wherein said head has serrations thereon and said serrations engage said end caps, said serrations being oriented to prevent rotation of said shank in a direction that would reduce the tension on said band.

* * * * *

UNITED STATES PATENT AND TRADEMARK OFFICE

CERTIFICATE OF CORRECTION

PATENT NO. : 4,313,287

DATED : February 2, 1982

INVENTOR(S) : Byron A. Romig, Jr.

It is certified that error appears in the above-identified patent and that said Letters Patent are hereby corrected as shown below:

Claim 5, line 20, delete "5" and insert therefor --4--;

Claim 14, line 61, delete "12" and insert therefor --13--;

Signed and Sealed this

*Twenty-fifth* Day of *May 1982*

[SEAL]

*Attest:*

GERALD J. MOSSINGHOFF

*Attesting Officer*

*Commissioner of Patents and Trademarks*